US010932033B2

(12) United States Patent
Wu et al.

(10) Patent No.: US 10,932,033 B2
(45) Date of Patent: Feb. 23, 2021

(54) SPEAKER BOX

(71) Applicant: AAC Technologies Pte. Ltd., Singapore (SG)

(72) Inventors: Rongrong Wu, Shenzhen (CN); Chengxia Ji, Shenzhen (CN); Kejia Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,575

(22) Filed: Jul. 30, 2019

(65) Prior Publication Data

US 2020/0045415 A1 Feb. 6, 2020

(30) Foreign Application Priority Data

Aug. 2, 2018 (CN) ..... 201821243927.8

(51) Int. Cl.
*H04R 1/02* (2006.01)
*H04R 1/28* (2006.01)

(52) U.S. Cl.
CPC ..... *H04R 1/2873* (2013.01)

(58) Field of Classification Search
CPC ..... H04R 1/02; H04R 1/025; H04R 1/026
USPC ..... 381/386, 388–389
See application file for complete search history.

(56) References Cited

U.S. PATENT DOCUMENTS 9,986,321 B1 * 5/2018 She ..... H04R 1/2803
2009/0190788 A1 * 7/2009 Yang ..... H04R 1/2842 381/386

* cited by examiner

*Primary Examiner* — Suhan Ni
(74) *Attorney, Agent, or Firm* — W&G Law Group LLP

(57) ABSTRACT

The present disclosure provides a speaker box. The speaker box includes an upper housing, a lower housing forming an accommodating space together with the upper housing, and a speaker unit accommodated in the accommodating space. The speaker unit includes a diaphragm configured to vibrate and produce sound. The diaphragm is disposed separately from the upper housing to define a front acoustic cavity. The speaker box further includes a sound channel communicating the front acoustic cavity with an external environment. The front acoustic cavity and the sound channel constitute a front cavity of the speaker box together. A baffle fixedly connected to the upper housing is disposed in the sound channel. The baffle and the upper housing define a resonant cavity in communication with the front acoustic cavity, and the resonant cavity has an inlet facing to the front acoustic cavity.

10 Claims, 8 Drawing Sheets

A-A

SPEAKER BOX

The present disclosure relates to electroacoustic conversion technology, and in particular, to a speaker box.

BACKGROUND

In recent years, with a rapid development of mobile communication technologies, customers have more access to mobile communication devices having a voice function, for example, portable phones, handheld game machines, and laptop computers. Quality of a designed speaker box as a voice playing apparatus directly influences voice performance of products such as mobile communication devices. To meet market demands for thin speaker boxes having high sound quality, higher requirements are imposed on design of a sound channel of the speaker box.

In related technologies, in order to form a second resonance peak near a frequency of 10 kHz to raise a high-frequency response, a longer sound channel is designed in the speaker box. As a result, a high-frequency second resonance peak of a front cavity is too high to be reduced by damping, a frequency response curve is not flat, and a noise at a corresponding position generated by a unit is amplified by the resonance peak. Besides, lengthening the sound channel increases an overall size of the speaker box, which is adverse to a development of the speaker boxes towards miniaturization.

Therefore, it is necessary to provide a new speaker box to resolve the foregoing limitations.

BRIEF DESCRIPTION OF THE DRAWINGS

To clearly illustrate technical solutions in embodiments of the present disclosure, drawings used in the description of the embodiments are briefly described below. Obviously, the drawings in the following description are only some embodiments of the present disclosure, and other drawings can be obtained by those of ordinary skill in the art according to these drawings without creative efforts.

DETAILED DESCRIPTION

Figure 1:
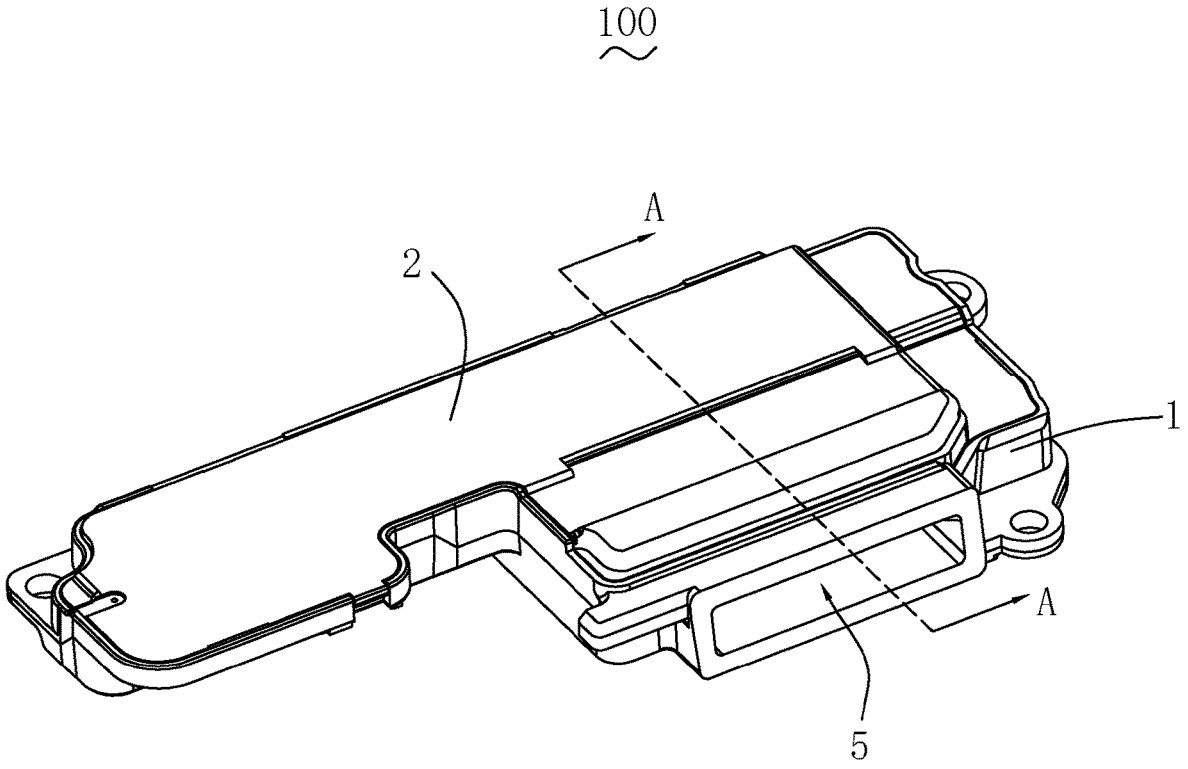
FIG. 1 is a schematic three-dimensional structural view of a speaker box according to the present disclosure.
Figure 2:
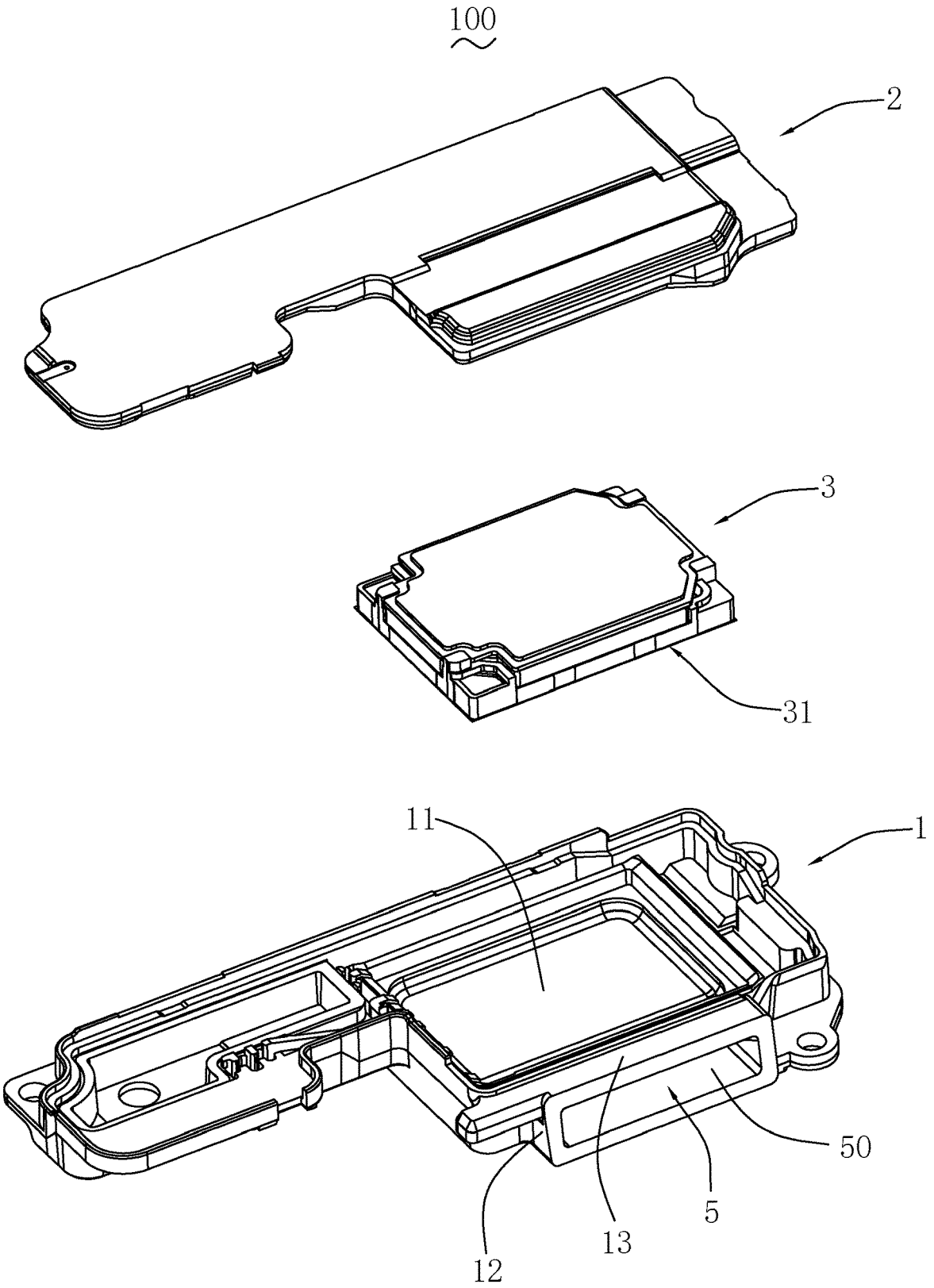
FIG. 2 is a schematic structural exploded view of the speaker box shown in FIG. 1.
Figure 3:
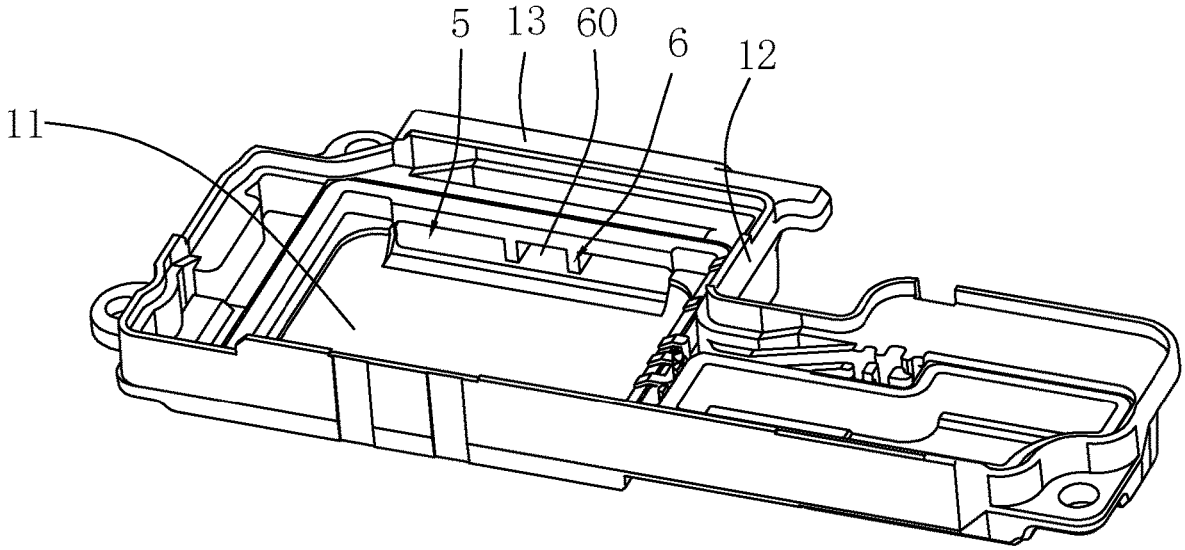
FIG. 3 is a schematic view of an upper housing of the speaker box shown in FIG. 1 from another aspect.
Figure 4:
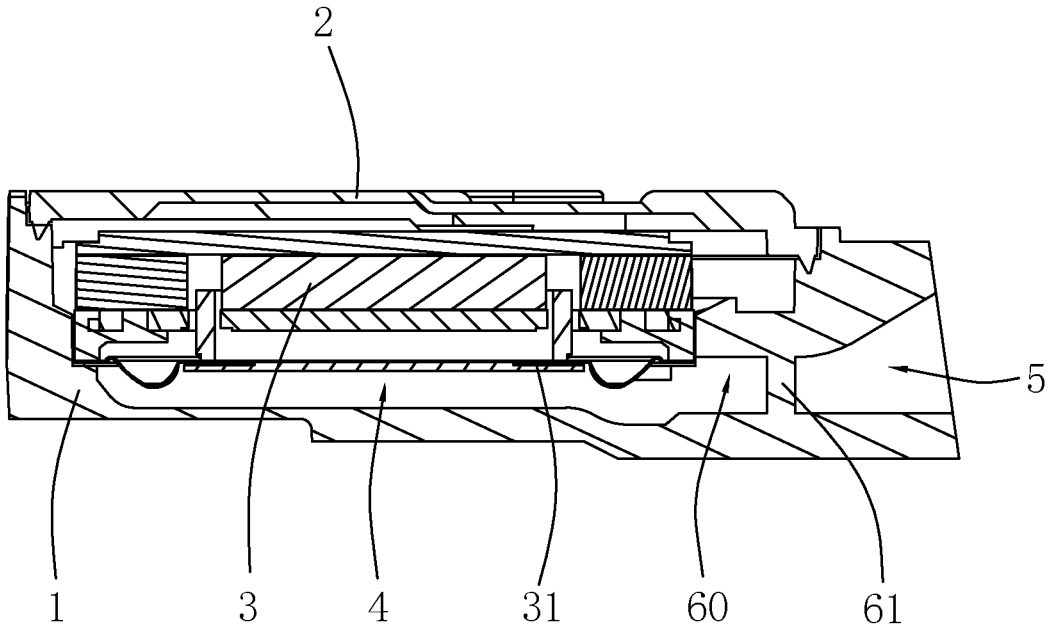
FIG. 4 is a sectional view of the speaker box along an A-A line shown in FIG. 1.
Figure 5A:
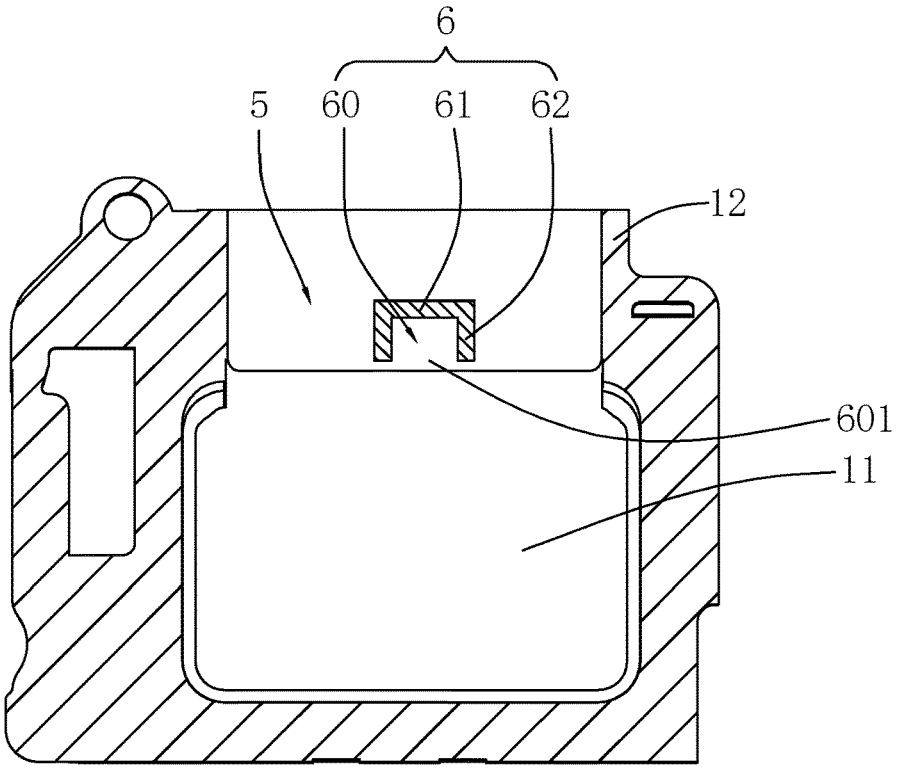
FIG. 5*a* to FIG. 5*d* are various schematic structural views of a baffle described in Embodiment 1 of the present disclosure.
Figure 5B:
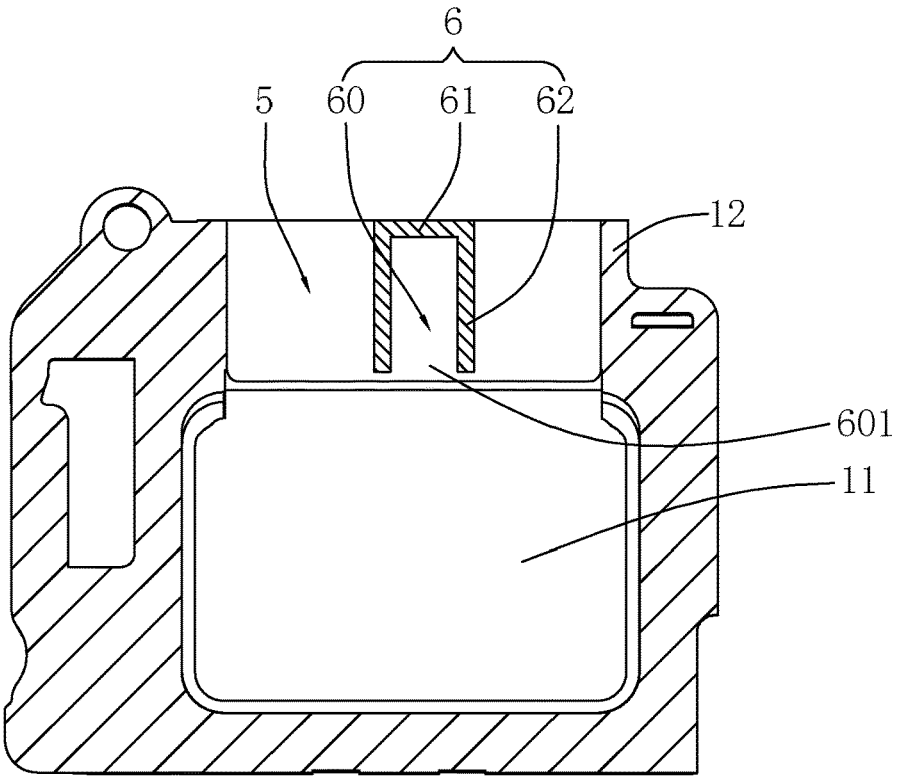
Figure 5C:
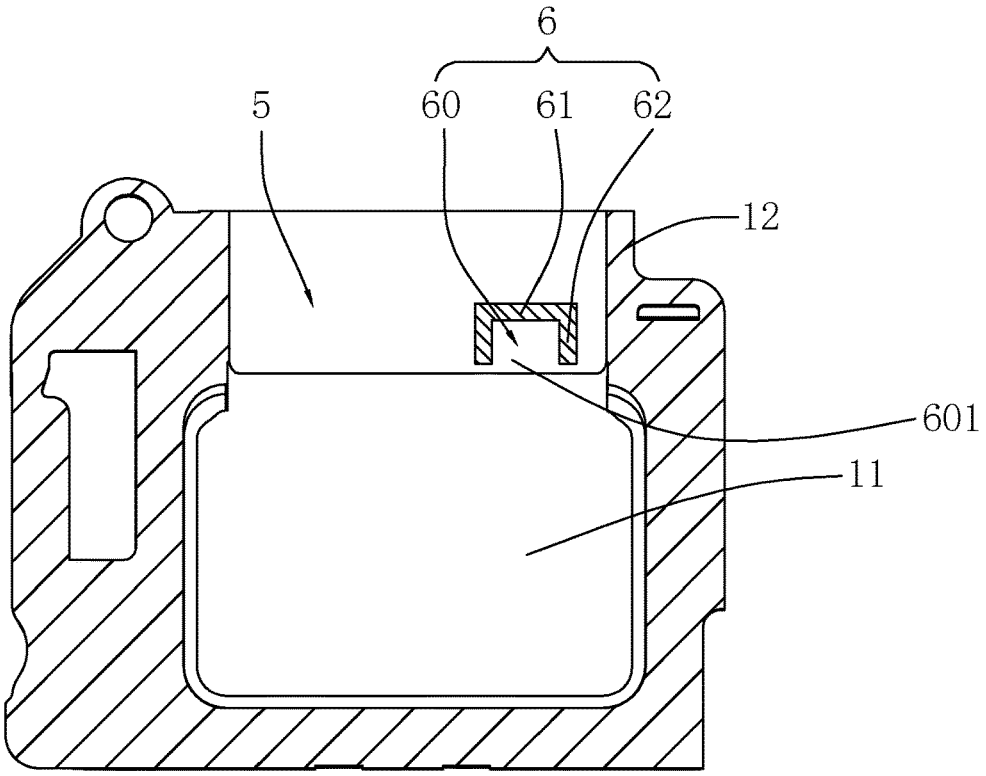
Figure 5D:
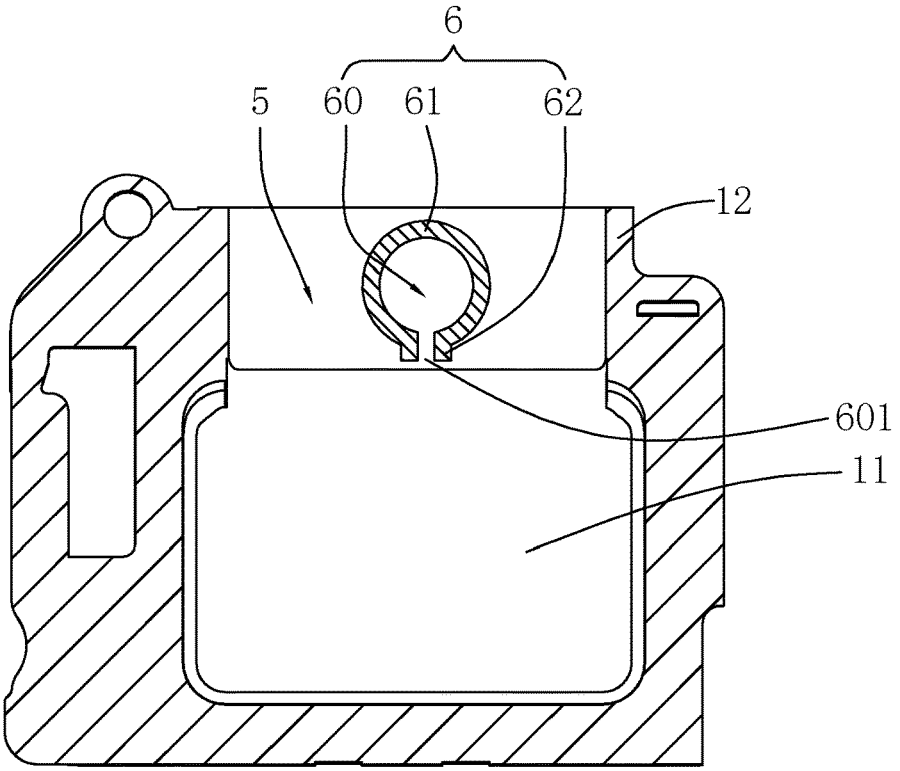

Technical solutions of embodiments of the present disclosure are described in details below with reference to accompanying drawings in the embodiments of the present disclosure. Obviously, the embodiments described are only some embodiments of the present disclosure rather than all embodiments. All other embodiments obtained by persons of ordinary skill in the art based on the embodiments of the present disclosure without creative efforts shall fall within the protection scope of the present disclosure.

Referring to FIGS. 1-4, the present disclosure provides a speaker box 100. The speaker box 100 includes an lower housing 1, a upper housing 2 defining an accommodating space together with the lower housing 1, a speaker unit 3 accommodated in the accommodating space and having a diaphragm 31, a front acoustic cavity 4 defined by the diaphragm 31 and the lower housing 1 which are disposed separately from each other, a sound channel 5 formed on the lower housing 1 and communicating the front acoustic cavity 4 with an external environment, and a baffle 6 disposed in the sound channel 5 and fixedly connected to the lower housing 1.

The lower housing 1 is configured to support and protect the speaker unit 3, and includes a top wall 11 disposed opposite to and separately from the diaphragm 31, a side wall 12 extending from an edge of the top wall 11 towards the diaphragm 31, and an extended wall 13 bent and extending from the side wall 12 toward a direction away from the diaphragm 31. The extended wall 13 is disposed separately from the top wall 11. The sound channel 5 is defined by the extended wall 13, the top wall 11, and the side wall 12 together.

The upper housing 2 covers the side wall 12 and defines the accommodating space together with the lower housing 1, and the speaker unit 3 is sandwiched between the upper housing 2 and the lower housing 1. The diaphragm 31 is configured to vibrate and produce sound. The front acoustic cavity 4 and the sound channel 5 constitute a front cavity of the speaker box 100 together.

Referring to FIG. 3 again, the baffle 6 extends from the top wall 11 towards the extended wall 13 and is fixedly connected to the top wall 11 and the extended wall 13.

Referring to FIGS. 5*a*-5*d*, specifically, the baffle 6 includes a first portion 61 away from one end of the speaker unit 3 and a second portion 62 bent and extending from the first portion 61 towards the speaker unit 3.

In this embodiment, there are two second portions 62. The two second portions 62 are disposed separately from each other, and the two second portions 62 are disposed separately from the side wall 12. The second portions 62 are flat plate-shaped. The first portion 61 and the two second portions 62 form a U-shaped structure with one end open and the other end closed, and the open end of the baffle 6 faces to the speaker unit 3. The baffle 6 and the lower housing 1 define a resonant cavity 60 together, and the resonant cavity 60 is in communication with the front acoustic cavity 4. The resonant cavity 60 has an inlet 601, and the inlet 601 faces to the front acoustic cavity 4. A cross section of the resonant cavity 60 in a direction perpendicular to a vibration direction of the diaphragm 31 is rectangular or circular.

Based on the Helmholtz resonance principle, the resonant cavity 60 can form an anti-resonance at the resonance peak of the front cavity, to improve flatness of a high-frequency response of the speaker box 100 and effectively reduce an effect of a noise amplified by a resonance of the front cavity, thereby effectively improving acoustic performance of the speaker box 100.

The baffle 6 and the lower housing 1 are integrally formed with a simple processing technology, and can replace a reinforcing rib in related technologies to support the top wall 11 and the extended wall 13, thereby strengthening strength of the housing and stability of the speaker box 100 and reducing vibration of the housing.

It can be understood that, a size of the resonant cavity 60 can be changed to effectively lower a second resonance peak by adjusting sizes of the first portion 61 and the second portion 62, thereby achieving an optimal sound effect. It should be noted that, in the present disclosure, a location for setting the baffle 6 is not limited. The baffle 6 may be disposed in the middle of the sound channel 5, or may be disposed near any side of the sound channel 5. Or the sound channel 5 includes a sound outlet 50, the first portion 61 of the baffle 6 is flat plate-shaped, and the first portion 61 is disposed at the sound outlet 50. The first portion 61 may be flat plate-shaped, arc-shaped, or V-shaped or another special-shaped structure. This is not limited in the present disclosure.

Embodiment 2

Figure 6:
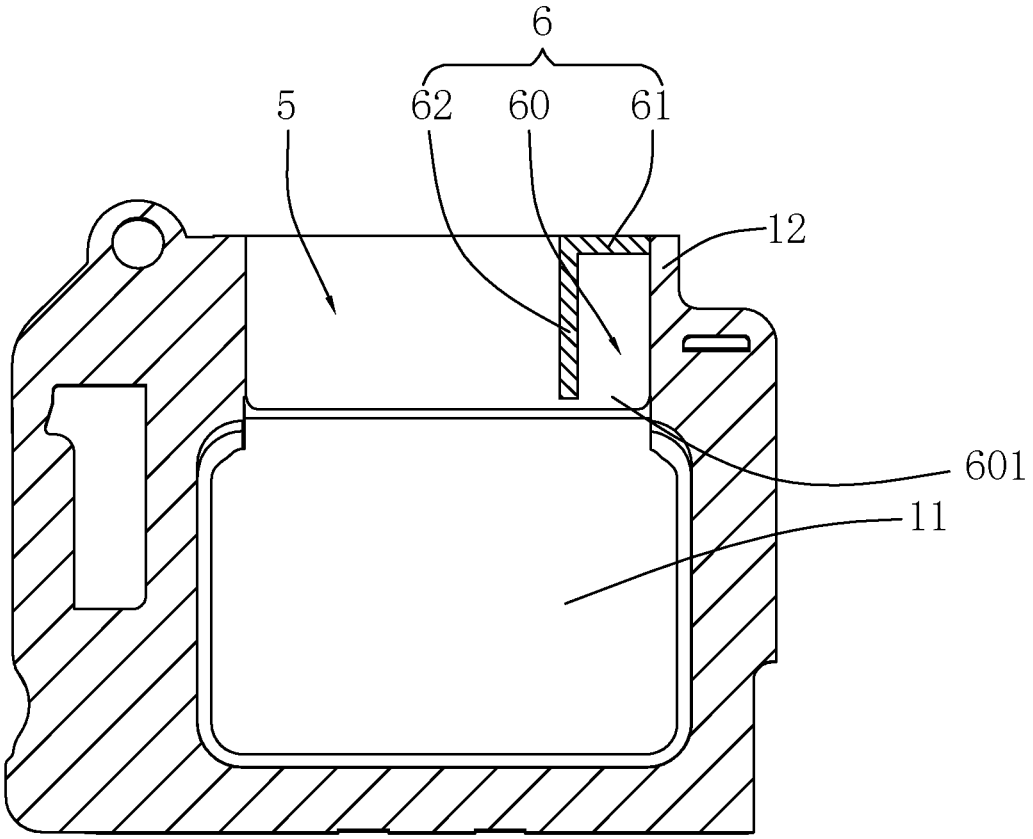
FIG. 6 is a schematic structural view of a baffle described in Embodiment 2 of the present disclosure.

Referring to FIG. 6, the present disclosure provides a speaker box. Differences between this embodiment and Embodiment 1 are as follows.

There is one second portion 62. One end of the first portion 61 is fixedly connected to the side wall 12, and the other end is fixedly connected to the second portion 62, namely, the second portion 62 is disposed separately from the side wall 12. The first portion 61, the second portion 62, the top wall 11, the side wall 12, and the extended wall define the resonant cavity 60 together. Such a design can reduce a quantity of the second portion 62 and increase a sound area of the sound channel 5, thereby improving acoustic performance of the speaker box.

Other technical features of this embodiment are the same as those of Embodiment 1, and details are not described in this embodiment.

Embodiment 3

Figure 7:
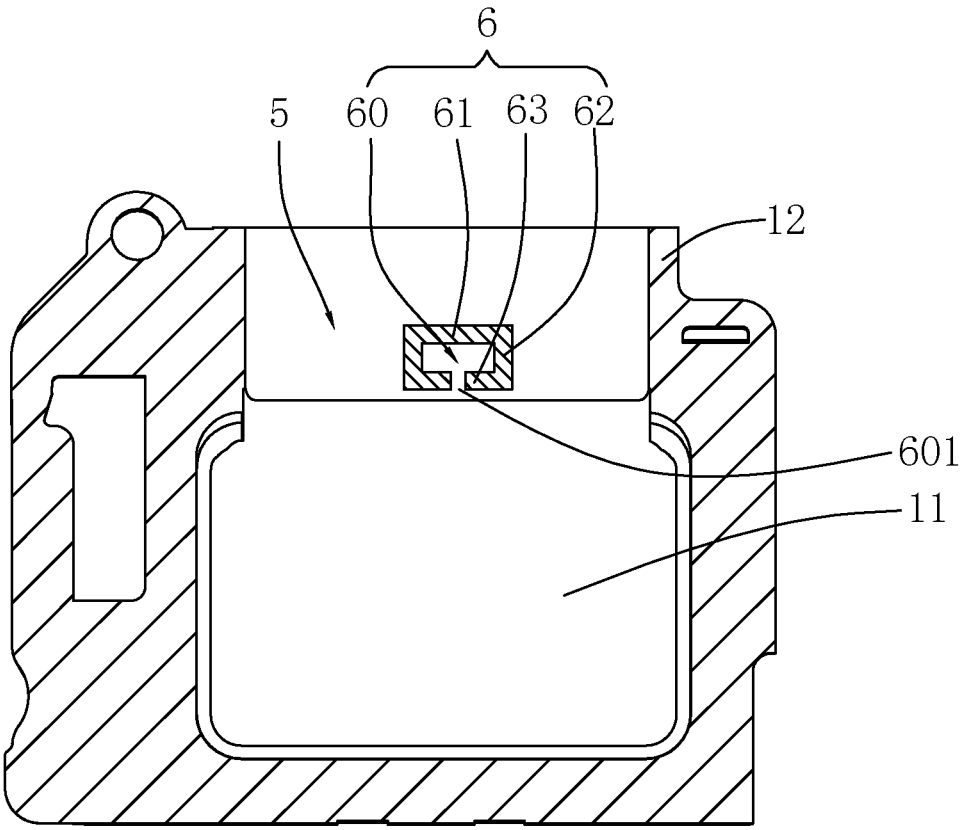
FIG. 7 is a schematic structural view of a baffle described in Embodiment 3 of the present disclosure.

Referring to FIG. 7, this embodiment provides a speaker box. Differences between this embodiment and Embodiment 1 are as follow.

The baffle 6 further includes a third portion 63. The third portion 63 is bent and extends from one end of the second portion 62 away from the first portion 61 and is disposed separately from the first portion 61. The first portion 61, the second portion 62, the third portion 63, the top wall 11, and the extended wall 13 define the resonant cavity 60 together.

Other technical features of this embodiment are the same as those of Embodiment 1, and details are not described in this embodiment.

Compared with related technologies, with respect to the speaker box in the present disclosure, the baffle 6 is disposed in the sound channel 5, the baffle 6 and the lower housing 1 of the speaker box define the resonant cavity 60 together, and the resonant cavity 60 is in communication with the front acoustic cavity 4. The resonant cavity 60 can form an anti-resonance at the resonance peak of the front cavity, to improve flatness of the high-frequency response of the speaker box and effectively reduce the effect of the noise amplified by the resonance of the front cavity, thereby effectively improving the acoustic performance of the speaker box.

The above descriptions are merely embodiments of the present disclosure, and it should be noted that those of ordinary skill in the art can make improvements without departing from the inventive concept of the present disclosure, and all such improvements shall fall within the protection scope of the present disclosure.

What is claimed is:

1. A speaker box, comprising an upper housing, a lower housing forming an accommodating space together with the lower housing, and a speaker unit accommodated in the accommodating space, wherein the speaker unit comprises a diaphragm configured to vibrate and produce sound, and the diaphragm is disposed separately from the lower housing to define a front acoustic cavity, wherein the speaker box further comprises a sound channel formed on the lower housing and communicating the front acoustic cavity with an external environment, and the front acoustic cavity and the sound channel constitute a front cavity of the speaker box together, wherein a baffle fixedly connected to the housing is disposed in the sound channel, the baffle and the upper housing form a resonant cavity in communication with the front acoustic cavity, and the resonant cavity has an inlet facing to the front acoustic cavity;

wherein the lower housing comprises a top wall disposed opposite to the diaphragm, a side wall extending from an edge of the top wall towards the diaphragm, and an extended wall bent and extending from the side wall toward a direction away from the diaphragm and defining the sound channel together with the top wall and the side wall, and the baffle extends from the top wall towards the extended wall and is fixedly connected to the top wall and the extended wall.

2. The speaker box according to claim 1, wherein the baffle comprises a first portion away from one end of the speaker unit and a second portion bent and extending from the first portion towards the speaker unit.

3. The speaker box according to claim 2, wherein the first portion is flat plate-shaped, arc-shaped, or V-shaped.

4. The speaker box according to claim 2, wherein there are two second portions, the two second portions are disposed separately from each other, and the second portions are disposed separately from the side wall.

5. The speaker box according to claim 2, wherein there is one second portion, the first portion is fixedly connected to the side wall, the second portion is disposed separately from the side wall, and the second portion, the top wall, and the side wall define the resonant cavity together.

6. The speaker box according to claim 4, wherein the baffle further comprises a third portion, the third portion is bent and extends from one end of the second portion toward a direction away from the first portion, and the third portion is disposed separately from the first portion.

7. The speaker box according to claim 5, wherein the baffle further comprises a third portion, the third portion is bent and extends from one end of the second portion toward a direction away from the first portion, and the third portion is disposed separately from the first portion.

8. The speaker box according to claim 4, wherein the sound channel comprises a sound outlet, the first portion of the baffle is flat plate-shaped, and the first portion is disposed at the sound outlet.

9. The speaker box according to claim 5, wherein the sound channel comprises a sound outlet, the first portion of the baffle is flat plate-shaped, and the first portion is disposed at the sound outlet.

10. The speaker box according to claim 1, wherein a cross section of the resonant cavity in a direction perpendicular to a vibration direction of the diaphragm is rectangular or circular.

* * * * *